US009574289B2

(12) United States Patent
Lieber et al.

(10) Patent No.: US 9,574,289 B2
(45) Date of Patent: Feb. 21, 2017

(54) NETTING WITH ELONGATION INDICATOR AND METHOD OF DETERMINING THE ELONGATION OF A NETTING

(75) Inventors: Yuval Lieber, Galed, IL (US); Yair Efrati, Mishmar Ha'Emek, IL (US)

(73) Assignee: TAMA PLASTIC INDUSTRY, Mishmar Ha'Emek (IL)

( * ) Notice: Subject to any disclaimer, the term of this patent is extended or adjusted under 35 U.S.C. 154(b) by 573 days.

(21) Appl. No.: 14/118,991

(22) PCT Filed: May 20, 2011

(86) PCT No.: PCT/IB2011/001090

§ 371 (c)(1),
(2), (4) Date: Jan. 30, 2014

(87) PCT Pub. No.: WO2012/160403

PCT Pub. Date: Nov. 29, 2012

(65) Prior Publication Data

US 2014/0179184 A1 Jun. 26, 2014

(51) Int. Cl.
*D04B 21/10* (2006.01)
*D04B 21/12* (2006.01)
(Continued)

(52) U.S. Cl.
CPC ..... *D04B 21/10* (2013.01); *B65B 11/00* (2013.01); *B65D 65/02* (2013.01); *D04B 21/12* (2013.01);
(Continued)

(58) Field of Classification Search
CPC ..... D04B 21/06; D04B 21/08; D04B 21/10; D04B 21/12; D04B 21/20
See application file for complete search history.

(56) References Cited

U.S. PATENT DOCUMENTS 4,917,008 A * 4/1990 van den Wildenberg ..... A01F 15/0715 100/15
5,104,714 A * 4/1992 Leiber ..... D01D 5/426 206/442
(Continued)

FOREIGN PATENT DOCUMENTS

AU 2008 243 223 A1 2/2010
DE 2007 032 351 A1 1/2009
(Continued)

OTHER PUBLICATIONS

International Search Report and Written Opinion dated Oct. 31, 2012 for Application PCT/IB2011/001090.

*Primary Examiner* — Danny Worrell
(74) *Attorney, Agent, or Firm* — Moser Taboada

(57) ABSTRACT

A knitted netting for wrapping an object is provided. When wrapping the object the knitted netting may have an indicated target elongation. The knitted netting includes first longitudinal franzes, first lateral schusses, at least two second longitudinal franzes, and at least one second lateral schuss. The schusses are knitted with the franzes to form the knitted netting. The first longitudinal franzes and the first lateral schusses are configured such that the spacing of the first longitudinal franzes decreases by less than 10% when elongating the knitted netting by 50% of the target elongation, the target elongation being from 15% to 300% of the length of the knitted netting. The second lateral schuss is an indicator schuss. The second longitudinal franzes are indicator franzes. The indicator schuss is knitted with the indicator franzes to form an elongation indicator for indicating the amount of longitudinal stretching of the knitted netting. The elongation indicator is configured such that the spacing of the indicator franzes decreases by more than 10% when elongating the knitted netting by 50% of the target
(Continued)

elongation. Further, a method of determining the longitudinal elongation of such a knitted netting with respect to a target elongation is provided.

23 Claims, 4 Drawing Sheets

(51) Int. Cl.
*B65D 65/02* (2006.01)
*B65B 11/00* (2006.01)
*B65D 30/00* (2006.01)

(52) U.S. Cl.
CPC ..... *B65D 29/00* (2013.01); *D10B 2505/10* (2013.01); *Y10T 442/10* (2015.04)

(56) References Cited

U.S. PATENT DOCUMENTS

| | | | | |
|---|---|---|---|---|
| 6,521,551 | B1 | 2/2003 | Mass et al. | |
| 7,024,893 | B2 * | 4/2006 | Dort | D04B 21/12 66/195 |
| 7,188,494 | B2 * | 3/2007 | Dort | D04B 21/12 66/195 |

FOREIGN PATENT DOCUMENTS

| | | | |
|---|---|---|---|
| WO | WO 2005/039852 | A2 | 5/2006 |
| WO | WO 2007/059345 | A2 | 5/2007 |

* cited by examiner

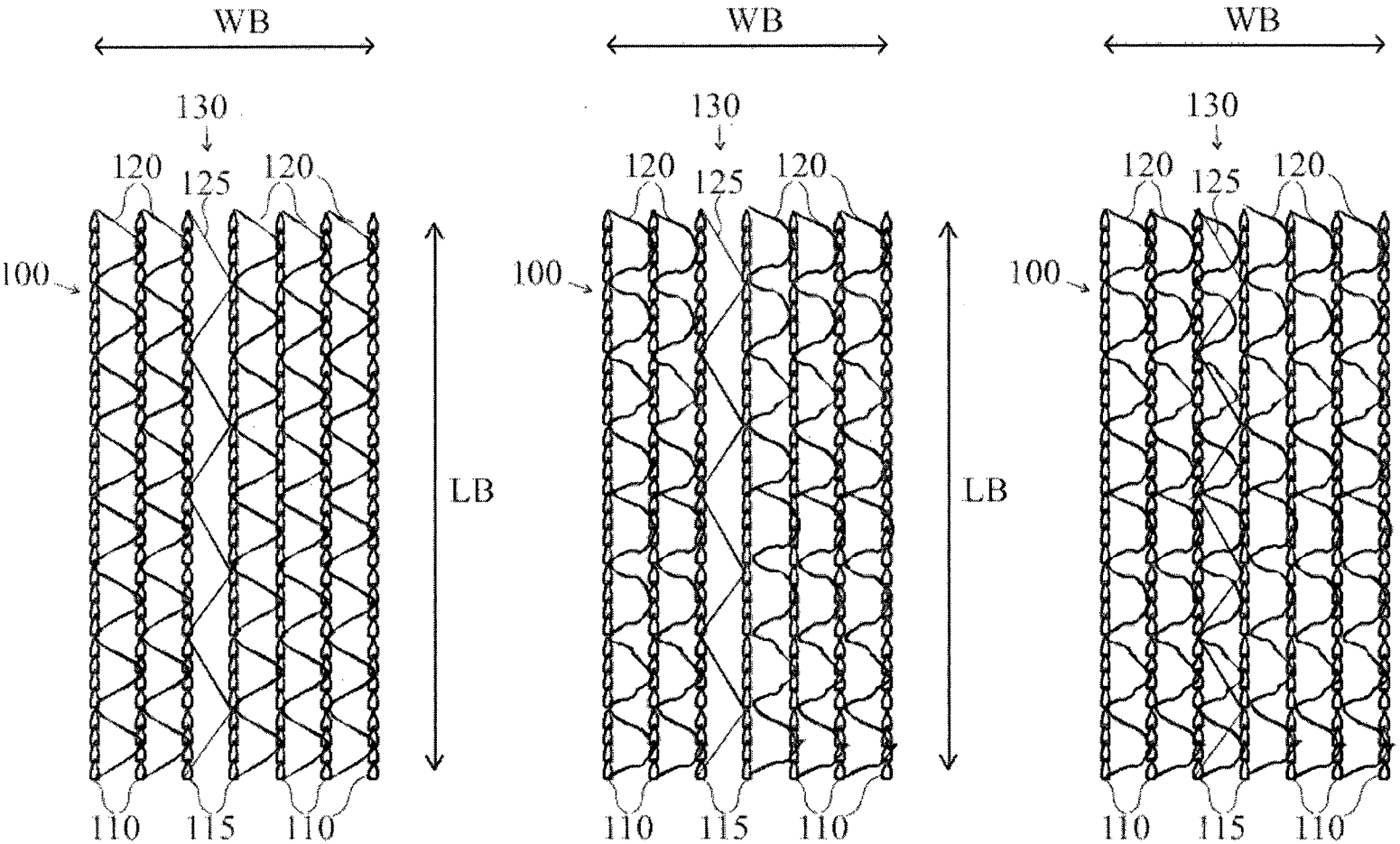
Fig. 7
Fig. 8
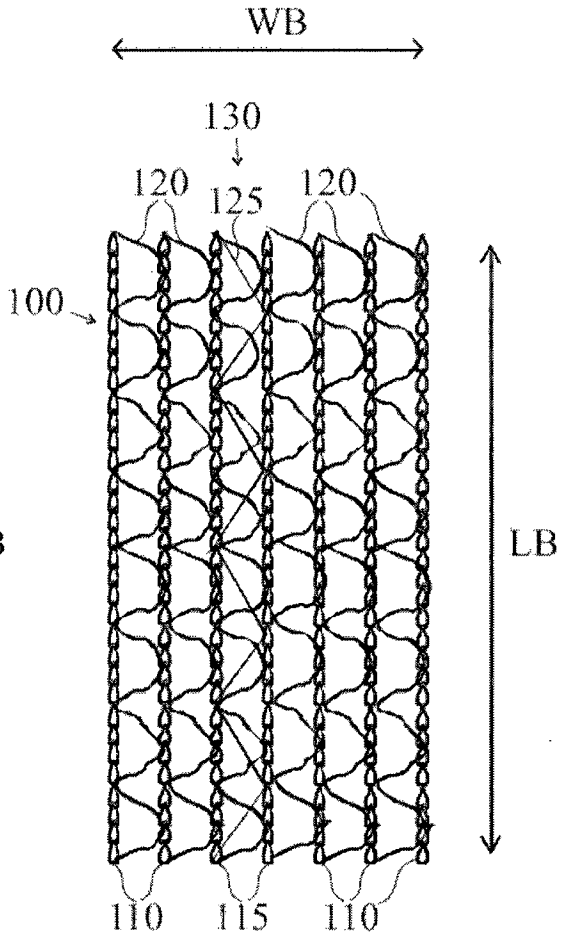
Fig. 9

NETTING WITH ELONGATION INDICATOR AND METHOD OF DETERMINING THE ELONGATION OF A NETTING

FIELD

Embodiments of the present invention relate to nettings for wrapping objects, e.g. for wrapping loads on pallets or bales of agricultural products, more specifically to a knitted netting, e.g. a Raschel knitted netting. Some embodiments relate to a knitted netting for, or a method of, determining the longitudinal elongation of the knitted netting with respect to a target elongation.

BACKGROUND

The use of Raschel knitted nettings for wrapping objects such as pallet loads is known in the Industry. Raschel knitted nettings usually include longitudinal ribbons or threads, known as franze or warp yarns, and of lateral ribbons or threads, known as schuss or fill yarns, which form a triangular structure between each pair of longitudinal ribbons. Such a Raschel knitted netting is described in U.S. Pat. No. 5,104,714.

Due to the triangular geometrical structure, such knitted nettings exhibit lateral shrinkage upon longitudinal elongation (i.e., there is narrowing of the net when it is stretched lengthwise). This problem with Raschel knitted nettings of triangular structure and the solution to this problem are disclosed in U.S. Pat. No. 6,521,551, which is incorporated by reference in its entirety.

These knitted nettings, which are intended, inter alia, for wrapping loads on pallets, usually have a characteristic elasticity and a predetermined degree of elongation capacity. The knitted nettings have to stretch according to the elongation percentage suited to the type of netting being used. There is direct connection between the required tension and the netting's elongation percentage, as a function of the elongation characteristics of the material from which the net is manufactured.

The knitted netting elongates as a function of the tension applied to the netting, irrespective of whether this tension is created upon initiation of wrapping by the wrapping machinery, or, typically at a higher percentage, due to forces created by the object being wrapped.

During the use of pallet nettings for wrapping loads on pallets, the knitted nettings are commercially elongated between 15% and 170% at present according to the characteristics of the netting and the settings of the wrapping machinery. An elongation of x %, where x is a real number, shall mean herein that the netting elongated by x % has a length of (100+x) % as compared to its original length.

The operator of the wrapping machinery endeavors to set the degree of elongation to a target value taking into consideration various factors such as the desired tension, the type of goods wrapped, the elongation capability of the knitted netting etc, all the above in order to optimize the wrapping and the utilization of the netting's characteristic. Specific percentage of elongation and tension is required in order to achieve good wrapping. If the elongation and tension is lower than that required, the load will not be properly secured and the operator will not utilize, and benefit from, the entire elongation capability of the netting. On the other hand, if the elongation and tension percentage exceeds the desired one, the netting can narrow, and this may result in the products wrapped (or their packaging) becoming damaged, e.g. by crushing of corners and cutting of products, or the netting can break or lose its strength leading to insufficient wrapping.

However, it is difficult for the operator of the wrapping machinery to determine the elongation percentage of the netting which will bring about the desired wrapping result. For example, in order to calculate the percentage of elongation, prior to commencing the wrapping process, the operator may measure the length of a predetermined portion of the netting (e.g. ten triangular bases) between two parallel Franze ribbons. Thereafter, the operator may measure the length of said predetermined portion of the netting at the end of the wrapping cycle while the netting is on the machinery, and deduce the percentage of elongation. This procedure, however, is tedious and time-consuming, and may interrupt the wrapping process, increasing the processing time.

If the elongation of the netting is not correctly determined, an undesired elongation may result, causing, as explained above, excess pressure on the wrapped products, damage to the wrapped products, loss of process time and loss of money.

Consequently, there is a need for an improved netting and for a method for determining or measuring elongation of a netting, overcoming the above problems.

SUMMARY

In light of the above, according to one embodiment, a method of determining the longitudinal elongation of a knitted netting with respect to a target elongation is provided. The method includes providing the knitted netting. The knitted netting includes first longitudinal franzes, first lateral schusses, at least two second longitudinal franzes, and at least one second lateral schuss. The schusses are knitted with the franzes to form the knitted netting. The first longitudinal franzes and the first lateral schusses are configured such that the spacing of the first longitudinal franzes decreases by less than 10% when elongating the knitted netting by 50% of the target elongation, the target elongation being from 15% to 300% of the length of the knitted netting. The second lateral schuss is an indicator schuss. The second longitudinal franzes are indicator franzes. The indicator schuss is knitted with the indicator franzes to form an elongation indicator for indicating the amount of longitudinal stretching of the knitted netting. The elongation indicator is configured such that the spacing of the indicator franzes decreases by more than 10% when elongating the knitted netting by 50% of the target elongation. The method further includes stretching the netting in longitudinal direction, and determining the longitudinal elongation of the knitted netting from the elongation indicator.

According to another embodiment, a method of determining the longitudinal elongation of a knitted netting is provided. The method includes providing the knitted netting. The knitted netting includes first longitudinal franzes, first lateral schusses, at least two second longitudinal franzes, and at least one second lateral schuss. The schusses are knitted with the franzes to form the knitted netting. The first longitudinal franzes and the first lateral schusses are configured such that the spacing of the first longitudinal franzes decreases by a first percentage when elongating the knitted netting by 20% or when elongating the knitted netting by 50% of a target elongation, the target elongation being from 15% to 300% of the length of the knitted netting. The second lateral schuss is an indicator schuss. The second longitudinal franzes are indicator franzes. The indicator schuss is knitted with the indicator franzes to form an elongation indicator for indicating the amount of longitudinal stretching of the knitted netting. The elongation indicator is configured such that the spacing of the indicator franzes decreases by a second percentage when elongating the knitted netting by 20% or when elongating the knitted netting by 50% of the target elongation. The ratio of the second percentage to the first percentage is larger than 1. The ratio can be larger than 2, 3, 4 or even larger than 5. The method further includes stretching the netting in longitudinal direction, and determining the longitudinal elongation of the knitted netting from the elongation indicator.

According to a further embodiment, a method of determining the longitudinal elongation of a knitted netting is provided. The method includes providing the netting, the netting including first longitudinal ribbons and first lateral ribbons, and at least one indicator ribbon. The at least one indicator ribbon has at least one characteristic having an influence on longitudinal stretching of the netting. The at least one specific characteristic is different from the corresponding characteristics of the first ribbons. The at least one characteristic of the at least one indicator ribbon is configured with a specifically designed value to effect an indication of a longitudinal elongation of the netting when the netting is stretched in longitudinal direction. The method further includes stretching the netting in longitudinal direction, and determining the longitudinal elongation of the knitted netting from the elongation indicator.

According to another embodiment, a knitted netting for wrapping an object is provided. When wrapping the object, the knitted netting may have an indicated target elongation. The knitted netting includes first longitudinal franzes, first lateral schusses, at least two second longitudinal franzes, and at least one second lateral schuss. The schusses are knitted with the franzes to form the knitted netting. The first longitudinal franzes and the first lateral schusses are configured such that the spacing of the first longitudinal franzes decreases by less than 10% when elongating the knitted netting by 50% of the target elongation, the target elongation being from 15% to 300% of the length of the knitted netting. The second lateral schuss is an indicator schuss. The second longitudinal franzes are indicator franzes. The indicator schuss is knitted with the indicator franzes to form an elongation indicator for indicating the amount of longitudinal stretching of the knitted netting. The elongation indicator is configured such that the spacing of the indicator franzes decreases by more than 10% when elongating the knitted netting by 50% of the target elongation.

According to another embodiment, a knitted netting for wrapping an object is provided. The knitted netting includes first longitudinal franzes, first lateral schusses, at least two second longitudinal franzes, and at least one second lateral schuss. The schusses are knitted with the franzes to form the knitted netting. The first longitudinal franzes and the first lateral schusses are configured such that the spacing of the first longitudinal franzes decreases by less than 10% when elongating the knitted netting by 20%. The second lateral schuss is an indicator schuss. The second longitudinal franzes are indicator franzes. The indicator schuss is knitted with the indicator franzes to form an elongation indicator for indicating the amount of longitudinal stretching of the knitted netting. The elongation indicator is configured such that the spacing of the indicator franzes decreases by more than 10% when elongating the knitted netting by 20%.

According to a further embodiment, a knitted netting for wrapping an object is provided. The knitted netting includes first longitudinal franzes, first lateral schusses, at least two second longitudinal franzes, and at least one second lateral schuss. The schusses are knitted with the franzes to form the knitted netting. The first longitudinal franzes and the first lateral schusses are configured such that the spacing of the first longitudinal franzes decreases by a first percentage when elongating the knitted netting by 20% or when elongating the knitted netting by 50% of a target elongation, the target elongation being from 15% to 300% of the length of the knitted netting. The second lateral schuss is an indicator schuss. The second longitudinal franzes are indicator franzes. The indicator schuss is knitted with the indicator franzes to form an elongation indicator for indicating the amount of longitudinal stretching of the knitted netting. The elongation indicator is configured such that the spacing of the indicator franzes decreases by a second percentage when elongating the knitted netting by 20% or when elongating the knitted netting by 50% of the target elongation. The ratio of the second percentage to the first percentage is larger than 1. The ratio can be larger than 2, 3, 4 or even larger than 5.

According to a further embodiment, a netting for wrapping an object is provided. The netting includes first longitudinal ribbons and first lateral ribbons, and at least one indicator ribbon. The at least one indicator ribbon has at least one characteristic having an influence on longitudinal stretching of the netting. The at least one specific characteristic is different from the corresponding characteristics of the first ribbons. The at least one characteristic of the at least one indicator ribbon is configured with a specifically designed value to effect an indication of a longitudinal elongation of the netting when the netting is stretched in longitudinal direction.

According to a further embodiment, a knitted netting for wrapping an object is provided. The knitted netting includes longitudinal ribbons and lateral ribbons, the lateral ribbons being knitted with the longitudinal ribbons to form a knitted netting with schusses and franzes. A schuss creates legs of a triangle while a franze creates a triangle base. Therein, at least one of the lateral ribbons of the knitted netting has an actual length more than 110% of the length of a calculated schuss length for said knitted netting. The knitted netting further includes longitudinal indicator ribbons for indicating the amount of longitudinal stretching of the knitted netting when wrapping the object.

According to a further embodiment, use is made of a netting according to any of the embodiments described herein to measure the longitudinal elongation of the netting by the elongation indicator or by an indicator ribbon or indicator ribbons. According to yet further embodiments, rolls of nettings according to any of the embodiments described herein are provided.

Embodiments are also directed to methods for manufacturing the disclosed nettings or rolls of such nettings. These method steps may be performed manually or automated, e.g. controlled by a computer programmed by appropriate software, by any combination of the two or in any other manner.

Further advantages, features, aspects and details that can be combined with embodiments described herein are evident from the dependent claims, the description and the drawings.

BRIEF DESCRIPTION OF THE DRAWINGS

A full and enabling disclosure to one of ordinary skill in the art is set forth more particularly in the remainder of the specification including reference to the accompanying drawings wherein:

FIGS. 7-9 show nettings according to embodiments described herein with elongation indicator having a different knitting pattern.

DETAILED DESCRIPTION

Figure 3:
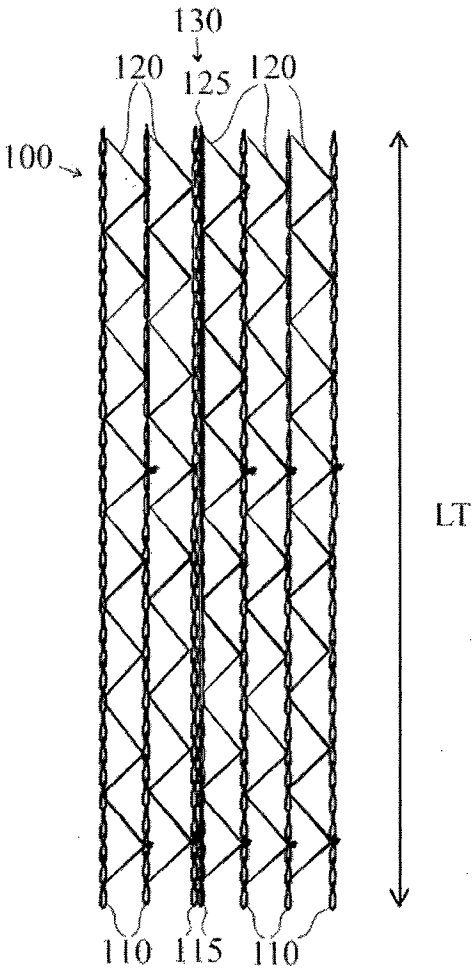
FIGS. 1-3 show a netting with elongation indicator according to embodiments described herein.

Reference will now be made in detail to the various exemplary embodiments, one or more examples of which are illustrated in each figure. Each example is provided by way of explanation and is not meant as a limitation. For example, features illustrated or described as part of one embodiment can be used on or in conjunction with other embodiments to yield yet further embodiments. It is intended that the present disclosure includes such modifications and variations.

Within the description of the drawings, the same reference numbers refer to the same components. Generally, only the differences with respect to the individual embodiments are described. The structures shown in the drawings are not necessarily depicted true to scale but rather serve the better understanding of the embodiments.

Figure 10:
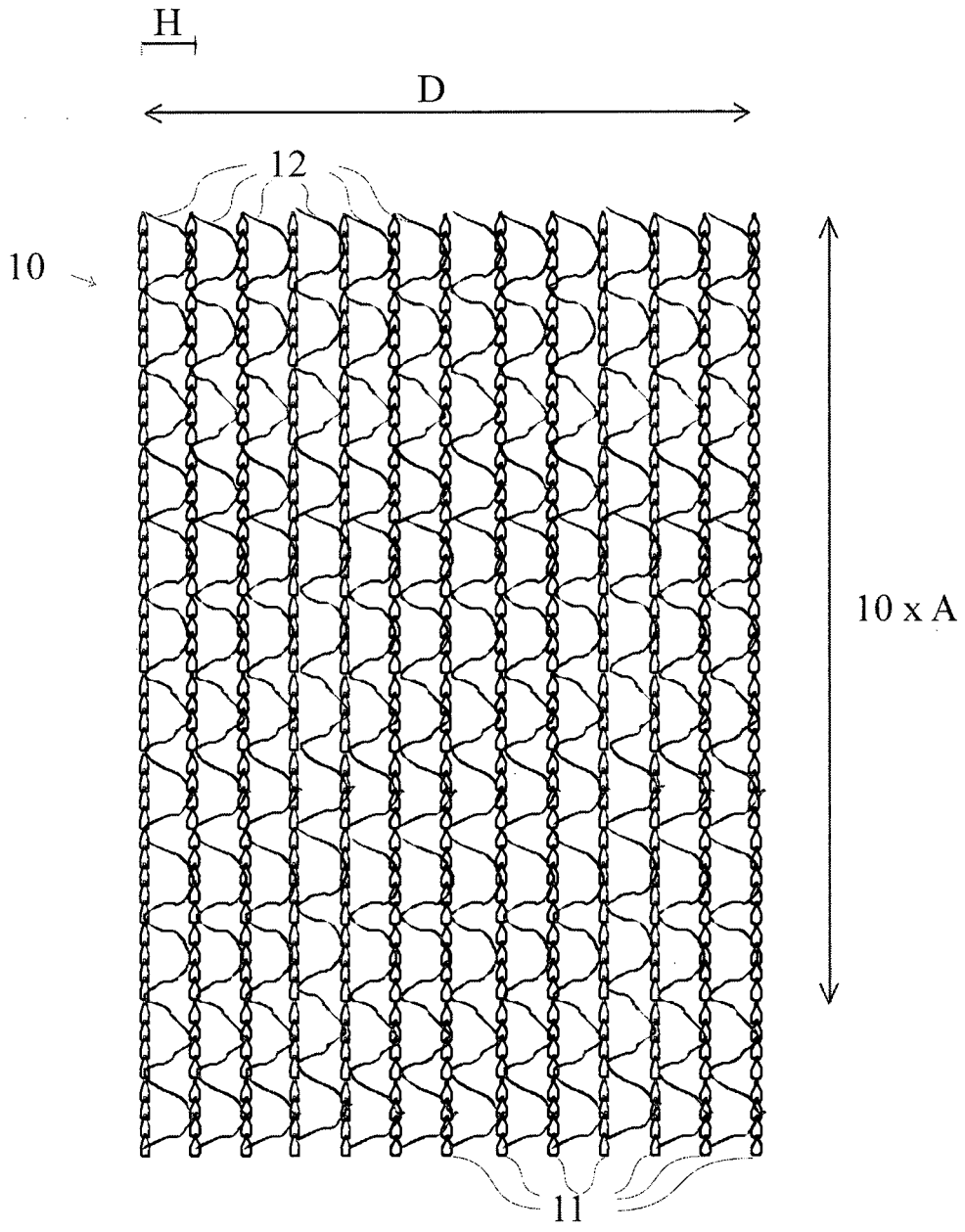
Fig. 10 (Prior Art)
FIG. 10 shows a Raschel knitted netting known from prior art.

FIG. 10 shows a Raschel knitted netting 10 known from U.S. Pat. No. 6,521,551. The knitted netting 10 includes franzes 11 and schusses 12, knitted with the franzes in zig-zag manner to form the netting 10. The schusses 12 are schusses having a length reserve enabling the netting 10 to reduce or prevent transverse shrinkage of the netting 10 when the netting is elongated in longitudinal direction L. More specifically, the actual schuss length is more than 110% of the calculated schuss length for the knitted netting.

Figure 1:
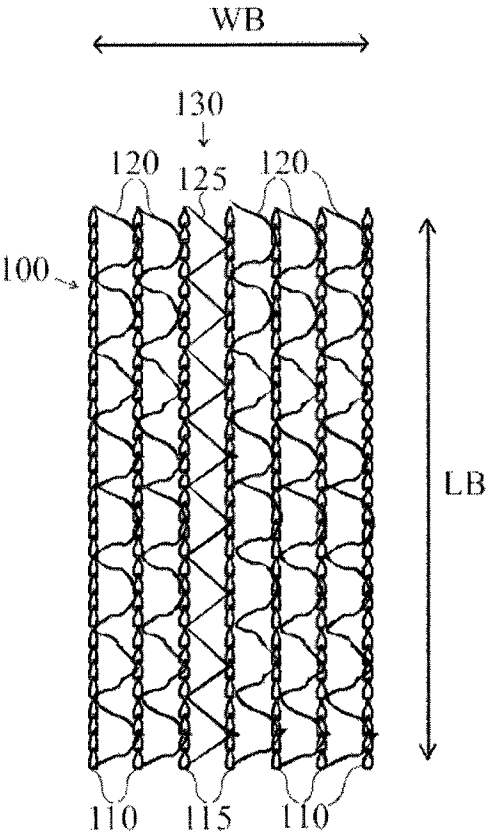

The suggested procedure for comparing actual schuss length with calculated schuss length may be described as follows: (1) Measure the length (D) between the two extreme franzes on a roll of knitted netting as shown in FIG. 1. (2) Divide the length (D) by the number of franzes minus one to define an average distance between two franzes (H). (3) Define an average length (A), i.e., the base, between two triangle legs each having a length S/2, by unrolling some of the knitted netting, measuring the total length of ten such "bases" (10×A) and dividing that total length by 10 to define the average length (A). This measurement should be performed while applying about 50 g to the franzes on which the schuss will be measured. (4) Calculate the schuss (S) length of two triangle legs as follows: $S=2((A/2)^2+H^2)^{1/2}$. (5) Determine an actual schuss length for distance 10A by unrolling some of the knitted netting and transversely cutting the franzes and schusses. Take out the schuss between two franzes and measure the length of the schuss while flattening the schuss on a flat plate to determine the actual schuss length. (6) For the knitted netting with length reserve of the schusses, the actual schuss length will exceed 10S by more than 10%. In summary the calculation may be described as: 100(measured schuss length/calculated schuss length)=% schuss reserve.

Therefore the actual lateral/schuss ribbon length may be defined as being at least 10% greater in length than the calculated lateral/schuss ribbon length, which is synonymous with the actual schuss length being more than 110% of the calculated schuss length for the knitted netting.

The above netting 10 provides an advantage over conventional Raschel nettings in that wrapping, in particular over-edge wrapping, is improved since lateral shrinkage is reduced or even prevented when the netting is elongated longitudinally. In some instances these nettings may be stretched up to the point of tearing before they become narrow.

However, both the above netting 100 and conventional Raschel nettings share the disadvantage that a momentary elongation upon longitudinal stretching of the netting is difficult to measure and that is difficult to provide the netting with a desired elongation and tension for wrapping an object. Therefore, there is a need for an improved netting and for a method to measure the elongation of the netting and to determine when a desired target elongation is reached. The netting can enable the operator of the wrapping machinery to know, and set with certainty, the desired elongation percentage of the netting. According to some embodiments, the operator can know or derive the values of elongation by merely looking at the knitted netting, which was not possible for any conventional netting.

FIG. 1 shows a netting 100 according to an embodiment of the present invention. The netting 100 is a knitted netting, typically a netting manufactured on a Raschel machine. The Raschel knitted netting is configured for wrapping goods and includes longitudinal and lateral ribbons interconnected with each other, e.g., polyolefin ribbons. The wrapped goods can, e.g., be loads on pallets or hay bales, where nettings for wrapping pallets are typically stretched more and have higher target elongation than nettings for hay bales. The Raschel knitted netting 100 includes first longitudinal ribbons 110 and second longitudinal ribbons 115, which are franzes of the Raschel knitted netting 100. The franzes 110 and 115 may be made of the same material and/or have identical stretching behavior. In other embodiments, the materials may not be the same and/or the stretching behavior may not be identical. The franzes 110 and 115 are connected by first lateral ribbons 120 and a second lateral ribbon 125, respectively, which are schusses of the Raschel knitted netting 100. The schusses 120 and 125 connect the franzes 110 and 115 to form a substantially triangular geometrical structure. Each pair of adjacent franzes connected by a schuss will be called a mesh row.

The schusses 120 are schusses having a length reserve enabling the netting 100 to reduce or prevent transverse shrinkage of the netting 100 when the netting is elongated in longitudinal direction. The actual schuss length of the schusses 120 can be more than 110% of the calculated schuss length for the knitted netting, as explained above. In particular, when rolled as knitted on the machine, the first lateral ribbons of the knitted netting can have an actual length more than 110% of the length of a calculated schuss length for the knitted netting.

The schuss 125, on the other hand, is configured with a predetermined length corresponding to the desired (target) elongation. The length of schuss 125 may, e.g., be determined according to the following formula: length of schuss 125=LB*[1+E], where LB is the actual production length of the knitted netting (see FIG. 1), and E is the target elongation percentage of the knitted netting. For example, if the target elongation of the knitted netting is 30% and the length of the netting is 1000 meters, then the length of the indicator Schuss may be designed to be 1000*[1+30%]=1300 meters. The length of the Schuss of the indicator may be achieved by using a feeding apparatus separated from the ISO apparatus used for the other ribbons of the knitted netting in a Raschel machine.

The schuss 125 and the franzes 115 connected by the schuss 125 form an elongation indicator 130 of the netting 100. When the netting is stretched in longitudinal direction, the elongation indicator 130 can visually indicate to an operator when the target elongation of the netting 100 is reached as is explained below. The schuss 125 and the franzes 115 are therefore called indicator schuss and indicator franzes, respectively.

Figure 2:
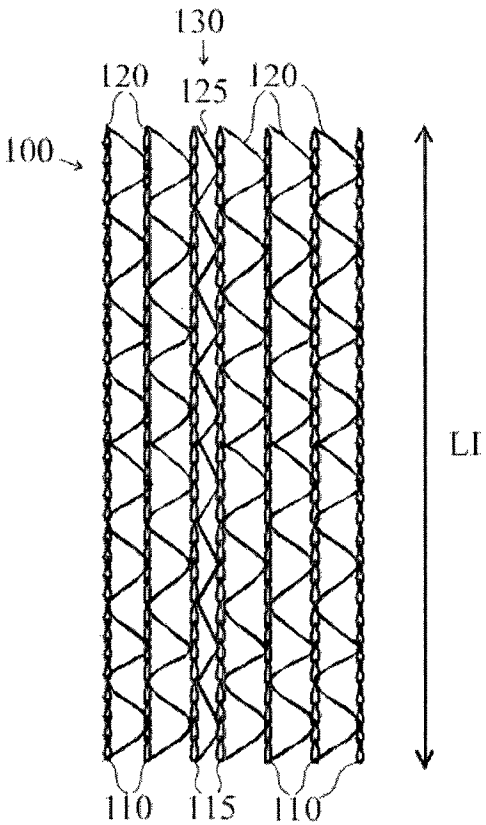

Due to the triangular structure of the knitted netting 100, the triangle base (A), being defined between two connection points of a schuss with its adjacent franzes, and being oriented in the longitudinal direction of the netting, increases upon longitudinal stretching of the netting. The triangle height (H) between the indicator franzes 115 of the elongation indicator 130, connected by the indicator schuss 125 having the fixed target length, diminishes and the two indicator franzes 115 draw closer to one another. This is illustrated in FIG. 2, where the length of the netting 100 has reached an intermediate length LI larger than the production length LB of the knitted netting, but still smaller than the target length.

When the knitted netting 100 is stretched further, as shown in FIG. 3, the indicator franzes 115 are drawn to each other by the indicator schuss 125 up to the point where their spacing is substantially zero and they appear as a single braid to the operator. When the franzes 125 meet each other, the elongation indicator 130 may no longer have a triangular geometry, but the indicator schuss 125 changes from forming triangles with franzes 115 into a state where it is substantially parallel between the two adjacent franzes 115. The operator thereby obtains a visual indication that the netting has reached the target elongation percentage, e.g., 30%. The elongated length of the netting is then the target length LT, which is substantially equal to the predetermined length of the indicator schuss 125.

At the same time, netting 100 exhibits reduced lateral shrinkage upon elongation in the meshes formed by the first franzes 110 and first schusses 120 that have a length reserve. The length of the indicator schuss 125 between the indicator franzes 115 is different from the length of the first schusses 120. For instance, the schuss 125 of the indicator 130 may be at least 5% shorter than the other schuss ribbons 120 of the netting 100. In certain ranges of schuss length reserve of the first schusses 120, the netting 100 does not become substantially narrower at all, except for the distance between the two indicator franzes 125 of the indicator 130. The netting 100 provides the advantage of reduced or substantially absent lateral shrinkage while at the same time allowing the visual determination of when the desired target length is reached upon longitudinal stretching of the netting.

The indicator 130 may be positioned in a center region or the center of the netting 100. When the indicator is positioned in locations other than the outer edges, the lateral shrinkage of the indicator 130 does not affect the advantageous wrapping properties of the netting 100.

The indicator 130 may, e.g., exhibit full lateral shrinkage as described above while the entire netting 100 will exhibit a reduced degree of lateral shrinkage of at most 50% of the netting's original width WB (see FIG. 1), typically at most 30% or even at most 20%.

The indicator schuss 125 and/or the indicator franzes 125 may have a different color than the color of the other ribbons of the netting. Thereby, the visibility and discernibility of the indicator 130 is increased, providing easier visible notice to the operator.

Figure 6:
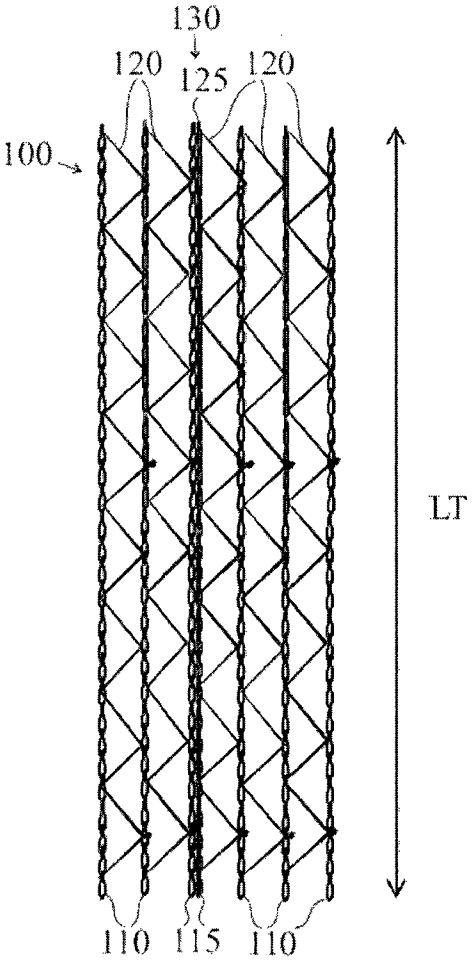
FIGS. 4-6 show a netting according to embodiments described herein with elongation indicator having a length reserve different from the length reserve of regular schusses.
Figure 5:
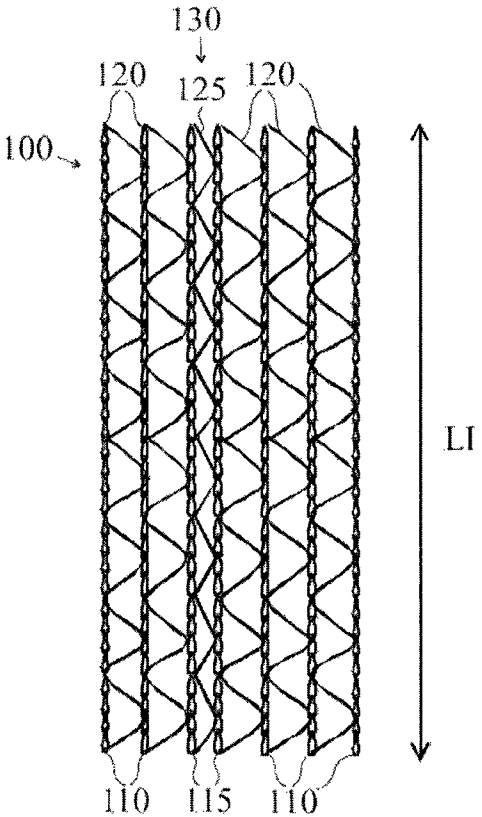
Figure 4:
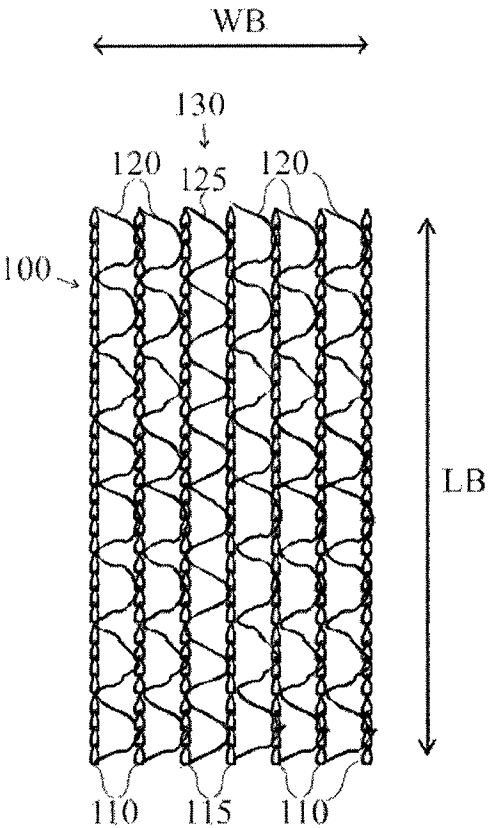

FIGS. 4 to 6 illustrate further embodiments of a netting with elongation indicator. In contrast to FIG. 1, the schuss 125 of the indicator 130 has a length reserve, but this length reserve is different from the length reserve of the first schusses 120. For instance, the length reserve of the first schusses 120 may be such that the actual schuss length is more than 110% of the calculated schuss length, in the sense described with respect to FIG. 10, while the length reserve of the schuss 125 of the indicator 130 is such that the actual schuss length is more than 100%, but less than 110% of the calculated schuss length, e.g., 105%. By giving a certain length reserve to the schuss of the indicator, one may, e.g., tune the target elongation at which the indicator franzes reach a pre-determined distance from each other, and which, as shown in FIG. 6, can be substantially zero. FIG. 5 shows an intermediate stage of the longitudinal stretching of the netting comparable to FIG. 2.

FIGS. 7 and 8 show a netting with elongation indicator 130 according to further embodiments. The schuss 125 of the elongation indicator 130 has a knitting geometry or a knitting pattern that is different from that of the first schusses 120. In FIGS. 7 and 8, the schuss 125 is connected to the indicator franzes 115 only at every second instance as compared to the first schusses 120, i.e., in intervals of two bases of the triangles formed by the schusses 120. More specifically, the schuss 125 has only half the number of connection points per unit length of a franze as compared to the first schusses 120. In FIG. 7, the first schusses 120 have no length reserve as in conventional nettings, while in FIG. 8 the first schusses 120 have a length reserve. In FIG. 9, the indicator schuss 125 has been knitted into the netting in addition to the regular knitting pattern. The indicator schuss 125 may be knitted into the netting by being knitted with the regular knitting pattern or by being wound around or being intertwined with the regular knitting pattern, which could, e.g., also be done in a separate step such as in a later stage of a production process. The indicator schuss 125 connects the indicator franzes 115 in addition to a first schuss also knitted between the indicator franzes. The first schusses in FIG. 9 are shown with a length reserve, but they could be without length reserve similar to FIG. 7.

The situation at the target elongation for the netting described with respect to FIGS. 8 and 9 would look similar to the situation illustrated in FIGS. 3 and 6. This same situation would look similar for the netting described with respect to FIG. 7 as well, but there might be more lateral shrinkage because of the conventional first schusses without length reserve.

The differing knitting pattern of the indicator schuss could also be any other kind of differing geometry. In particular, the number of connections per unit length of a franze can be smaller for the indicator schuss as compared to the first schusses, but could also be larger, e.g., if the indicator schuss does not have a length reserve, but the first schusses do. The ratio of the number of connections per unit length of franze for the indicator schuss (numerator) in relation to the first schusses (denominator) can, e.g., be in the range from 0.1 to 0.9, typically from 0.25 to 0.5, such as ¼, ⅓, or ½.

Conventional nettings having schusses without length reserve may be upgraded by an elongation indicator. In such a case, e.g., the lateral shrinkage of the franzes connected by the schusses without length reserve and/or the lateral shrinkage of the entire netting could be more than 10% of the netting's original width at half the target elongation or at 20% elongation, or could be even more than 15%, 20% or 50% of the netting's original width. Still, the distance between the indicator franzes decreases faster than the distance between first, regular franzes, wherein the shrinking ratio is, e.g., at least two to one. For instance, the netting shown in FIG. 7 could represent a netting that is similar to a conventional netting with such an improvement.

According to another embodiment, a knitted netting for wrapping an object is provided. The knitted netting includes: longitudinal ribbons and lateral ribbons, the lateral ribbons being knitted with the longitudinal ribbons to form the knitted netting with schusses and franzes, wherein a schuss creates legs of a triangle while a franze creates a triangle base. Therein, when rolled as knitted on the knitting machine, at least one of the lateral ribbons of the knitted netting has an actual length more than 110% of the length of a calculated schuss length for the knitted netting. The netting includes longitudinal indicator ribbons for indicating the amount of longitudinal stretching of the knitted netting when wrapping the object. The amount of longitudinal stretching may be indicated by the spacing of the longitudinal indicator ribbons. The spacing may decrease by more than 10% when elongating the knitted netting by 10%.

According to another embodiment, a Raschel knitted netting is provided, including at least one indicator characterized in that upon reaching a predetermined elongation percentage of the netting a schuss of the indicator is straightened and two parallel franze ribbons of the indicator meet. The knitted netting may be further characterized in that upon full lateral shrinkage of the indicator the netting itself exhibits lateral shrinkage up to 50% of its original width.

In the foregoing, the distance between the two parallel Franze ribbons of the indicator served as a visual indication of the netting's rate of elongation. Therein, the reaching of the target elongation need not be indicated by the state of the netting where the indicator franzes meet, but could, e.g., be indicated by another, typically easily discernible state, e.g., when the indicator franzes are at half the spacing they originally had or at half the spacing the other franzes momentarily have. Embodiments are not limited to a specific material and the ribbons, in particular the ribbons of the indicator, can be made of any type of material. Further, embodiments are not limited to a certain location of the indicator. There could also be more than one indicator, positioned in different locations on the netting.

Other, typically visual means may be provided for the equipment operator to determine the best tension value and to control this value, regardless of the material being wrapped, and without the necessity for external facilities or the uncomfortable measuring and calculating method. According to some embodiments of the invention, the measurability of the elongation is an inherent part of the netting. Embodiments are directed to any netting having an inherent elongation indicator for measuring the length of the netting when the netting is stretched lengthwise. Embodiments relate to a netting having a visual indicator designated for the determination of the elongation percentage of the netting during working conditions, e.g., for the purpose of achieving optimal tension values for wrapping objects such as pallets or agricultural bales.

According to an embodiment, a netting is provided. The netting may be a knitted netting such as a Raschel knitted netting, i.e., a netting knitted on a Raschel machine. The knitted netting may have any knitting pattern, e.g., the typical zig-zag pattern of schusses between adjacent franzes of Raschel nettings, but also any other pattern such as criss cross, or plurality of schuss ribbons between to adjacent franzes, and the like. Alternatively, the netting may be a woven or extruded netting or the like. The netting, or at least the franzes thereof, may be a plastic netting, e.g. a netting including or consisting of polyolefin ribbons, or any other suitable material. The netting, or at least the franzes thereof, can, e.g., include or consist of natural materials such as cotton fibers or rubber based materials or other stretchable materials.

The netting may be configured for wrapping objects. The objects are typically larger objects, e.g., goods or products on pallets or agricultural bales such as hay bales. The objects may have at least one dimension larger than 0.5 or 1 m, typically at least two dimensions each larger than 0.5 or 1 m, or three dimensions each larger than 0.5 or 1 m.

The netting includes longitudinal ribbons or threads, known as franzes in the case of a Raschel knitted netting. The expression "longitudinal" refers to the longitudinal, i.e., lengthwise direction of the netting. For example, in a knitted netting knit on a Raschel machine, the longitudinal ribbons are the franzes which run in the machine direction when the netting is knit on the Raschel machine. The longitudinal extension of the netting can be much larger than its lateral extension, e.g., at least one or two orders of magnitude larger. The lateral extension is the cross-machine extension in the case of a netting knitted on a Raschel machine. The longitudinal extension (length) of the netting may be more than 100 m (hundred meters), e.g., from 100 m to 20000 m, or from 500 m to 2000 m, e.g., about 1000 m. The lateral extension (width) of the netting may be less than 6 m, typically less than 2 m or even less than 1 m, e.g, from 0.1 m to 5 m, or from 0.2 m to 2 m, or from 0.3 to 0.8 m, e.g., about 0.5 m (about 20 inches) or about 0.75 m (about 30 inches).

The netting includes lateral ribbons or threads, named schusses in the case of a Raschel knitted netting. The expression "lateral ribbon" means that the ribbon has a substantial extension in the lateral direction, but typically does not mean that the lateral ribbon only extends in the lateral direction, which is true, e.g., for rectangular patterns. The extension in the lateral direction is substantial if the ratio of the lateral component of extension to the longitudinal component of extension is at least 0.05, or at least 0.1. This ratio may be more than 0.7 or more than 0.8. The ratio is infinitely large for extension only in the lateral direction.

The longitudinal ribbons are connected with the lateral ribbons. They may, e.g. be inter-knitted or interwoven. Each pair of longitudinal ribbons connected with each other by at least one lateral ribbon or a part thereof will be called mesh row. The netting may, e.g., include at least 5 mesh rows or at least 8 mesh rows, e.g., from 5 to 40 mesh rows, typically from 8 to 30 mesh rows, such as 8, 18, 19, 20, 21 or 28 mesh rows. The number of longitudinal ribbons is the number of mesh rows plus one. For instance, a 50 cm (20 inch) wide netting could have 19, 20, 21 or 22 franzes such that it would 18, 19, 20 or 21 mesh rows, respectively. A 75 cm (30 inch) wide netting could have 29 franzes and therefore 28 mesh rows. The average spacing between longitudinal ribbons, i.e., the production spacing, e.g., as wound up on a roll, may be at least 0.1 cm, or at least 0.5 cm or at least 1 cm, e.g., from 1 cm to 10 cm, typically from 2 cm to 5 cm, such as 2.54 cm (1 inch).

The netting includes an elongation indicator. The elongation indicator is capable of measuring, respectively indicating, the length or elongation of the netting, typically with respect to a target length or target elongation. The elongation indicator may be configured to indicate or determine when a target length or target elongation of the netting is reached when the netting is longitudinally stretched. The elongation indicator may be is a gauged elongation indicator. That means, the indication of the elongation provided by the elongation indicator is gauged. Gauging may include comparison with a gauge quantity or a gauge measurement of the elongation under working conditions. For instance, the target elongation can be guaranteed to have been reached, within certain tolerances, under predetermined operating conditions of a specific wrapping machine due to the gauging.

A gauge measurement may be performed as follows: (1) Provide a sample of the netting having a certain production length, e.g. by unrolling a certain amount of netting from a roll, applying a small weight to the longitudinal ribbons that is just enough to straighten them and measuring a length with a ruler. The certain length may, e.g., be 10 triangle bases in the case of a Raschel knitted netting as described herein). (2) Stretch the certain length of the netting by the wrapping machine until the elongation indicator indicates the reaching of a target elongation (e.g., when two indicator franzes meet as described above). (3) Measure the actual length of the stretched sample with a ruler. (4) Compare the actual length of the stretched sample with the target length, respectively the target elongation, that the elongation indicator is supposed to indicate. (5) Declare the elongation indicator gauged if the actual length of the stretched sample is within measurement tolerances of the target length.

The elongation indicator may be visual elongation indicator. The term "visual indicator" as used herein shall mean an indicator that indicates the respective quantity or state, e.g., the elongation, such that this quantity or state can be determined with the naked eye. This does not mean that the visual indication provided by the visual indicator is actually determined with the naked eye (e.g., a sensor system may be used instead), but that determination with the naked eye is possible. Alternatively or additionally, the elongation indicator may be an audible elongation indicator producing a signal noise when a target elongation is reached. The signal noise may be such that it is audible for human even under operating conditions with background noise such as the noise of a wrapping machine. The elongation indicator may be a non-tactile elongation indicator. This means, that the netting need not be touched for the measurement of the momentary elongation or for the determination of whether the target elongation has been reached. Thereby, cumbersome and time-consuming measurements, e.g., as described with respect to FIG. 10, become unnecessary.

The netting, respectively the elongation indicator, includes at least one indicator ribbon. The netting, respectively the elongation indicator, may include more than one indicator ribbon, e.g., two indicator ribbons or three indicator ribbons as in the embodiments described with respect to FIGS. 1-9, or more than three indicator ribbons. The at least one indicator ribbon has at least one characteristic responsive to, and/or having an influence on and/or being influenced by, longitudinal stretching of the netting. For example, in the embodiments described with respect to FIGS. 1-9, the three indicator ribbons, one lateral and two longitudinal ribbons, had a variable spacing responsive to lateral stretching of the netting as characteristic in the above sense.

The at least one specific characteristic is different from the corresponding characteristics of the other ribbons. For instance, the spacing of the first ribbons of the embodiments described above was not responsive to lateral stretching, or at least responsive to a lesser extent than the characteristic variable spacing of the indicator ribbons. In particular, according to a quantification that can be combined with any of the embodiments described herein, the spacing between the first ribbons may shrink by a first percentage when the netting is stretched by 20%. Alternatively, this spacing may shrink by a first percentage when the netting is stretched by 50% of the target elongation. The spacing between the indicator ribbons may shrink by a second percentage when the netting is stretched by 20%. Alternatively, this spacing between the indicator ribbons may shrink by a second percentage when the netting is stretched by 50% of the target elongation. The ratio of the second to the first percentage is larger than 1. This ratio can be larger than 1.5, 2, 3, 4, 5, or even 10 or 15. The ratio can, e.g., be in the range between 1 and 20, such as in the range from 1.1 to 10 or from 2 to 5. If the spacing between the first ribbons at 20% elongation or at 50% of the target elongation has not shrunk or even has increased, the first percentage is taken to be zero, and the ratio becomes infinitely large. If the ratio of the shrinking is larger than 1 at all elongations of the netting, including the cases that the ratio is infinitely large because the spacing between the first ribbons does not shrink or even increase for certain values of the elongation of the netting, then the shrinking speed of the distance between the indicator ribbons is said to be greater than the shrinking speed of the distance between the first ribbons upon elongation of the netting. The ratio of these speeds can be larger than 2, 3, 4, 5, or even 10 or 15. In other words, the spacing between indicator ribbons may shrink faster, typically much faster such as 2, 3, 4, 5, 10 or 15 times faster than the spacing between the first ribbons. This can hold both for nettings using first ribbons and/or indicator ribbons with length reserve as well as for nettings using first ribbons and/or indicator ribbons without length reserve.

The at least one characteristic may be a gauged characteristic. For instance, the spacing between longitudinal indicator ribbons as described with respect to FIGS. 1-9 can be gauged by a gauge measurement under working conditions, such that the momentary spacing is guaranteed to correspond, within certain tolerances, to a momentary elongation of the netting. In particular, the spacing may be gauged such that it becomes zero when the target elongation is reached under operating conditions of a specific wrapping machine. The at least one characteristic of the at least one indicator ribbon is configured to effect an indication of a longitudinal elongation of the netting when the netting is stretched in longitudinal direction The at least one indicator ribbon may be placed in lieu of a corresponding ribbon in the pattern of the netting. In the embodiments described with respect to FIGS. 1-8, at least the lateral indicator ribbon was of a different, second kind and replaced one of the lateral ribbons of a first kind. However, an indicator ribbon may alternatively be provided in addition to a regular, first ribbon of the pattern of the netting, as shown in FIG. 9. For instance, a longitudinal indicator ribbon may be knitted with, wound around, or intertwined with, a first longitudinal ribbon, and/or a lateral indicator ribbon may be knitted with, wound around, or intertwined with, a first lateral ribbon.

Providing an additional indicator ribbon to supplement a corresponding regular ribbon may have the advantage of increasing the breaking strength of the netting. For instance, the lateral indicator schuss of FIGS. 1-9 may tear if the target elongation is surpassed, leading to a rupture of the whole netting. However, if this lateral indicator schuss is knitted with, or intertwined with, an additional lateral schuss of the first kind having a length reserve, then the netting does not rupture even if the indicator schuss rips. Replacement of a regular ribbon with an indicator ribbon may, e.g., have the advantage that less material is used, possibly leading to cost savings.

In some embodiments, the at least one indicator ribbon includes or is a longitudinal indicator ribbon. The longitudinal indicator ribbon may form the elongation indicator all by itself. For instance, the longitudinal indicator ribbon may have a color that is dependent on the tensile stress applied to the ribbon. The characteristic of such a longitudinal ribbon is therefore its tension dependent color. A certain color of the longitudinal indicator ribbon that corresponds to the tensile stress applied at the moment where the target elongation is reached can indicate this target state of the netting to an operator. Providing the at least one indicator ribbon with a normal color, i.e., a color that does not change upon elongating the netting can help making the at least one indicator ribbon better discernible if this normal color is different from the color of the other ribbons, but such a normal color does not constitute a characteristic responsive to longitudinal stretching.

Alternatively or additionally, the longitudinal indicator ribbon may be designed to rip when the target elongation is reached (e.g., when intertwined with a regular longitudinal ribbon that does not rip at the target elongation), or may be designed to self-untying knots provided in the indicator ribbon, where the tensile stress at the target elongation overcomes frictional forces in the knots to untie them, or may be designed to provide any other visual elongation indication, or may be designed to provide an audible elongation indication, such as a crackling sound at target elongation due to breaking of microstructures of the ribbon or the like. The characteristic in these instances are tear strength of the indicator ribbon, friction of knots, breaking strength of microstructures etc.

In other embodiments, the at least one indicator ribbon includes or is a lateral indicator ribbon. This lateral indicator ribbon may have the same properties described in the previous paragraph with respect to a longitudinal indicator ribbon.

In further embodiments, the at least one indicator ribbon includes at least one longitudinal indicator ribbon and at least one lateral indicator ribbon. For example, the at least one indicator ribbon may include two longitudinal indicator franzes and one indicator schuss as in the embodiments described with respect to FIGS. 1-9.

The netting may include first longitudinal ribbons that are spatially separated and are connected by first lateral ribbons in some embodiments. The netting may further include at least two longitudinal indicator ribbons with a spacing between them. The spacing is the production spacing, e.g., the spacing the netting has when rolled up on a roll as manufactured and before stretching the netting for wrapping purposes. The netting further includes at least one lateral indicator ribbon connecting the at least two longitudinal indicator ribbons. One lateral indicator ribbon may connect two longitudinal indicator ribbons in such a way that the spacing between the two longitudinal indicator ribbons is controlled by a specifically designed property of the lateral indicator ribbon, e.g., at least one of the following: its length, its position of connection points to the longitudinal indicator ribbons, its tensile resistance and other properties of the material it is made of. The controlled spacing decreases to a greater extent than the spacing between the first longitudinal ribbons when the netting is stretched in longitudinal direction. The at least two longitudinal indicator ribbons and the at least one lateral indicator ribbon form one elongation indicator or several elongation indicators of the netting. The elongation indicator(s) is/are adapted to indicate the target longitudinal elongation of the netting. When the longitudinal indicator ribbons reach a predetermined lateral distance from each other when the netting is stretched in longitudinal direction.

The netting may be a knitted netting for wrapping an object. Therein, the object is wrapped with the knitted netting having an indicated target elongation. The netting may include first longitudinal franzes, first lateral schusses, at least two second longitudinal franzes, and at least one second lateral schuss. The schusses are knitted with the franzes to form the knitted netting.

Therein, the first longitudinal franzes and first lateral schusses may be configured such that the spacing of the first longitudinal franzes decreases by less than 10% when elongating the knitted netting by 50% of the target elongation. The target elongation may, e.g., be from 5% to 400% of the length of the knitted netting, typically from 15% to 300% of the length of the knitted netting, or from 15% to 200%, e.g., 70% or 100%. Therein, the spacing and length are the production spacing and production length, i.e., the original spacing and length of the netting as manufactured. A target elongation of x % means that the target length of the netting is its original length plus x % of its original length. For instance, the first lateral schusses may be the schusses with length reserve described with respect to FIGS. 1-6 and 8-9.

Further, the at least one second lateral schuss may be at least one indicator schuss. The at least two second longitudinal franzes may be at least two indicator franzes. One indicator schuss may be knitted with two indicator franzes to form an elongation indicator for indicating the amount of longitudinal stretching of the knitted netting. The indicator franzes and schusses may form several elongation indicators. The elongation indicator(s) may be configured such that the spacing of the indicator franzes decreases by more than 10%, or even more than 15%, 20%, 25%, 30%, 40%, 50%, when elongating the knitted netting by 50% of the target elongation. For instance, an indicator schuss as described with respect to FIGS. 1-9 may be provided to achieve this effect. The elongation indicator may be configured such that the spacing of the indicator franzes decreases by more than 10% when elongating the knitted netting by 20%, by 15% or even only by 10% of its (production) length.

The elongation indicator may be configured to indicate the target elongation of the knitted netting by a decrease of the spacing of the indicator franzes by more than 85%, or by more than 90%, or by more than 95%, or by substantially 100% or even by 100%. Therein, the term "substantially 100%" means that the spacing has decreased to zero apart from measurement tolerances, in particular tolerances of visual inspection by an operator, who may regard the indicator franzes to meet even if they do not yet actually touch, the space in between them being indiscernible for the naked eye.

According to some embodiments, e.g., as in the embodiments described with respect to FIGS. 1-9, the length of the at least one indicator schuss may be configured to control the spacing between the indicator franzes. The length of the indicator schuss may be configured to be substantially equal to the (production) length of the netting plus the target elongation. Therein, the length can be considered substantially equal if it is within measurement tolerances of a gauge measurement. Since the length of the indicator schuss can be easily designed in relation to the length of the netting, a simple and efficient way to control the spacing for elongation indication purposes is achieved.

The at least one indicator ribbon, e.g., the longitudinal indicator franzes and indicator schuss(es), may be arranged in a center region or in the center of the netting. In other words, the elongation indicator may be arranged in a center region or in the center of the netting. Therein, the term "center region" means a region of the netting separated from each of the two lateral edges of the netting by a distance of at least 15% of the width of the netting. The center of the netting is the mesh row having the same number of mesh rows on its both sides. Arranging the elongation indicator in a center region has the advantage that wrapping of the edges of an object may be improved, in particular for those embodiments based upon length indication by lateral shrinkage between longitudinal ribbons, because edge wrapping may in particular be disadvantageously influenced by lateral shrinking of the netting. Further, the elongation indicator may be more easily seen if arranged near the center of the netting.

The at least one indicator ribbon, e.g., the at least two indicator franzes and/or the at least one indicator schuss, may have a different color than the other ribbons, e.g., the first longitudinal franzes and first lateral schusses. If the elongation indicator, or at least some of the ribbons forming part thereof, have a different color, the elongation indicator is better discernible for an operator of the wrapping machine.

The netting may include one, two, three or more than three elongation indicators according to any of the embodiments described herein. Therein, the plurality of elongation indicators may be configured to indicate the same target elongation, but may, e.g., be distributed over the netting for easier visibility and referencing. In other embodiments, the elongation indicators may be configured to indicate different target elongations. For example, a first elongation indicator may be configured to indicate the desired target elongation for wrapping, while a second indicator, e.g., having a different color, is configured to indicate a critical elongation. Therein, the critical elongation is the elongation of the netting beyond which breaking or rupture of the netting will soon occur, e.g., will occur if the netting is stretched by another 5% of it original length.

Alternatively or additionally, one elongation indicator may be adapted to indicate a minimum desired target elongation and another one may be configured to indicate a maximum desired target elongation. Therein, the minimum desired target elongation may, e.g., be the elongation below which an object would not be properly wrapped. For instance, the wrapping would not be strong enough to prevent shifting of goods on pallets. The maximum desired target elongation may be the elongation above which the goods or their packaging, in particular the edges thereof, might be damaged due to too strong wrapping forces. In this way, an operator may know to operate in a desired target elongation range, e.g., a range from 15% to 300% elongation of the netting. This gives the operator the freedom to vary the elongation according to possibly different sizes and dimensions of the objects to be wrapped, where he can use his experience to adapt the elongation, but be sure at the same time to provide neither too weak nor too strong wrapping.

For instance, the netting may include at least one second indicator ribbon. The at least one second indicator ribbon may have at least one second characteristic responsive to, and/or having an influence on and/or being influenced by, longitudinal stretching of the netting. The at least one second characteristic may be different from the at least one characteristic of the at least one first indicator ribbon described herein. The at least one second characteristic may, e.g., be a characteristic varying of the spacing between second longitudinal indicator ribbons different from the characteristic varying of the spacing between the first longitudinal indicator ribbons previously described, but may be any other characteristic responsive to longitudinal stretching as well.

The characteristic varying spacing between the second longitudinal indicator ribbons may be controlled by a specifically designed length of the at least one second indicator ribbon. For instance, a second lateral indicator ribbon may be provided with a length reserve smaller than the length reserve of the first lateral ribbons, such that its actual length is larger than the length of the first lateral indicator ribbon, but smaller than the actual length of the first lateral ribbons. According to embodiments which can be combined with any of the embodiments described herein, a netting is provided having three different kinds of lateral ribbons, wherein the actual length of the three different kinds of lateral ribbons is pairwise different.

For example, modifying the embodiments described with respect to FIGS. 1-9, the netting may include three second indicator ribbons, namely two second indicator franzes connected by a second indicator schuss, providing a variable spacing responsive to lateral stretching of the netting, the variable spacing being the at least one second characteristic. The second indicator schuss may have a length reserve smaller than the length reserve of the first schusses, while the first indicator schuss may not have a length reserve and be intertwined with a first schuss that is also connecting the first indicator franzes. If the netting is stretched, the first indicator may become straightened at a certain point, which may indicate that a minimum desired target elongation or a desired target elongation is reached. If the netting is stretched further, the first indicator schuss may break, but the netting will not be ruptured because the first indicator schuss was provided in addition to a regular schuss of the first kind with a length reserve. At some point, the second indicator schuss may become straightened, pulling its adjacent second indicator franzes together such that they meet. This may, e.g., indicate that a maximum desired target elongation or a critical elongation has been reached.

Further embodiments are directed to rolls of any of the nettings described herein. Yet further embodiments are directed to the use of a netting with elongation indicator according to any of the embodiments described herein in order to measure the longitudinal elongation of the netting by the elongation indicator, e.g., by the at least one indicator ribbon.

Other embodiments are directed to a method of measuring the elongation of a netting, e.g., a method of determining the longitudinal elongation of a knitted netting with respect to a target elongation. The method includes providing a netting according to any of the embodiments described herein.

The method includes stretching the netting in longitudinal direction. The method may include measuring the momentary elongation by indication from the elongation indicator. The method may include determining the longitudinal elongation of the knitted netting from the elongation indicator. Stretching the netting may include stretching the netting until the longitudinal indicator ribbons reach a predetermined lateral distance from each other, thereby indicating the longitudinal elongation of the netting. Determining the longitudinal elongation may include determining when longitudinal indicator ribbons, e.g., two indicator franzes, reach a predetermined spacing from each other, thereby indicating reaching of the target longitudinal elongation of the netting.

The predetermined spacing may be half the production spacing, i.e., the spacing between the longitudinal indicator ribbons before stretching of the netting, or may be 10%, or 5% or less, e.g., substantially zero or zero. In other words, determining the longitudinal elongation of the knitted netting may include determining when the spacing between longitudinal indicator ribbons decreases to at most 10% of the production spacing, or to at most 5% or to substantially zero or even to zero, thereby indicating reaching of the target longitudinal elongation of the netting.

Therein the length of a lateral indicator ribbon may control the spacing between the longitudinal indicator ribbons that it connects. When the knitted netting is stretched in longitudinal direction, the lateral indicator ribbon may decrease this spacing to a greater extent than the spacing between any other longitudinal ribbons connected by first lateral ribbons as described herein. Stretching the netting in longitudinal direction may include stretching the netting until the lateral indicator ribbon is substantially straightened along the longitudinal direction.

The method may include wrapping an object with the knitted netting when the target longitudinal elongation has been reached. The object may be any of the objects described herein.

Embodiments of the present invention are also directed to a method of manufacturing a netting with elongation indicator(s) according to embodiments described herein. The manufacturing method may include any steps necessary for building such elongation indicator(s) into the netting. For example, the specific length of an indicator schuss may be provided by using a feeding apparatus separated from the feeding apparatus used for the other ribbons of a knitted netting in a Raschel machine. A feeding apparatus may include an apparatus for cutting plastic sheets or film into ribbons/tapes and stretching the ribbons/tapes for knitting them into nets using the knitting machine. The feeding apparatus may, e.g., be an ISO machine produced by ISO Maschinenbau GmbH, Germany.

EXAMPLES

Measurements on the shrinking behavior of certain nettings equipped with an elongation indicator according to embodiments described herein have been conducted. The nettings are (i) Net 1 having regular schusses with length reserve and having a target elongation of about 70%, (ii) Net 2, a conventional netting similar as in FIG. 7 without length reserve and an indicator schuss knitted in an interval of two bases of the regular schusses (half the number of connection points to the franzes per unit length of a franze), (iii) Net 3, a conventional netting without length reserve and an indicator schuss knitted in an interval of three bases (a third of the number of connection per unit length of a franze as compared to the regular schusses), where the indicator schuss has been knitted into the netting in addition to a regular schuss instead of replacing a regular schuss (similarly as in FIG. 9), (iv) Net 4 having regular schusses with length reserve and having a target elongation of about 50%, and (v) Net 5, having regular schusses with length reserve and having a target elongation of about 25%. Both nettings (ii) and (iii) have a target elongation of about 30%.

Table 1 lists the distance and relative shrinkage (in percent of the distance at 0% elongation) between a first pair of franzes connected by regular schusses as a function of the elongation of the netting. Table 2 lists the same quantities for a second pair of franzes connected by regular schusses, and Table 3 lists these quantities for a pair of indicator franzes. The first and second pair of franzes were not located in direct vicinity to the indicator franzes, but were located two rows away. The pairs of first, second and indicator franzes were located at an inner zone of the netting. A positive percentage value of the shrinkage means that the distance increased as compared to the distance at 0% elongation.

TABLE 1

| | Distance between the first pair of franzes (mm) | | | | | | | | | |
|---|---|---|---|---|---|---|---|---|---|---|
| | Net 1 | | Net 2 | | Net 3 | | Net 4 | | Net 5 | |
| elongation | Distance | Shrinkage | Distance | Shrinkage | Distance | Shrinkage | Distance | Shrinkage | Distance | Shrinkage |
| 0% | 29 | | 21 | | 21 | | 29 | | 28 | |
| 5% | | | | | 21 | 0% | | | 28 | 0% |
| 10% | 30 | 3% | 21 | 0% | 21 | 0% | 30 | 3% | 29 | 4% |
| 15% | | | | | 19 | −9.5% | | | 29 | 4% |
| 20% | 30 | 3% | 21 | 0% | 20 | −5% | 29 | 0% | 28 | 0% |
| 25% | | | | | 20 | −5% | | | 29 | 4% |
| 30% | 28 | −3% | 20 | −5% | 18 | −14.3% | 29 | 0% | | |
| 35% | | | | | | | | | | |
| 40% | 27 | −7% | | | | | 27 | −7% | | |
| 45% | | | | | | | 26 | −10% | | |
| 50% | 28 | −3% | | | | | 26 | −10.3% | | |
| 55% | | | | | | | | | | |
| 60% | 29 | 0% | | | | | 24 | −17% | | |
| 65% | | | | | | | | | | |
| 70% | 28 | −3% | | | | | 21 | −28% | | |
| 75% | | | | | | | | | | |
| 80% | 26 | −10% | | | | | | | | |

TABLE 2

| | Distance between the second pair of franzes (mm) | | | | | | | | | |
|---|---|---|---|---|---|---|---|---|---|---|
| | Net 1 | | Net 2 | | Net 3 | | Net 4 | | Net 5 | |
| elongation | Distance | Shrinkage | Distance | Shrinkage | Distance | Shrinkage | Distance | Shrinkage | Distance | Shrinkage |
| 0% | 30 | | 20 | | 22.5 | | 26 | | 27 | |
| 5% | | | | | 21 | −7% | | | 26.5 | −2% |
| 10% | 30 | 0% | 20 | 0% | 21 | −7% | 27 | 4% | 27 | 0% |
| 15% | | | | | 21 | −7% | | | 28 | 4% |

TABLE 2-continued

| Distance between the second pair of franzes (mm) | | | | | | | | | | |
|---|---|---|---|---|---|---|---|---|---|---|
| | Net 1 | | Net 2 | | Net 3 | | Net 4 | | Net 5 | |
| elongation | Distance | Shrinkage | Distance | Shrinkage | Distance | Shrinkage | Distance | Shrinkage | Distance | Shrinkage |
| 20% | 31 | 3% | 21 | 5% | 20 | −11% | 25 | −4% | 28 | 4% |
| 25% | | | | | 20 | −11% | | | 28 | 4% |
| 30% | 30 | 0% | 19 | −5% | 19 | −16% | 26 | 0% | | |
| 35% | | | | | | | | | | |
| 40% | 30 | 0% | | | | | 25.5 | −2% | | |
| 45% | | | | | | | 26 | 0% | | |
| 50% | 28 | −7% | | | | | 25 | −4% | | |
| 55% | | | | | | | | | | |
| 60% | 30 | 0% | | | | | 24 | −8% | | |
| 65% | | | | | | | | | | |
| 70% | 29 | −3% | | | | | 29 | 12% | | |
| 75% | | | | | | | | | | |
| 80% | 26 | −13% | | | | | | | | |

TABLE 3

| Distance between pair of indicator franzes (mm) | | | | | | | | | | |
|---|---|---|---|---|---|---|---|---|---|---|
| | Net 1 | | Net 2 | | Net 3 | | Net 4 | | Net 5 | |
| elongation | Distance | Shrinkage | Distance | Shrinkage | Distance | Shrinkage | Distance | Shrinkage | Distance | Shrinkage |
| 0% | 20 | | 18 | | 21 | | 15 | | 17 | |
| 5% | | | | | 20 | −5% | | | 16 | −6% |
| 10% | 20 | 0% | 14 | −22% | 15 | −29% | 13 | −13% | 13 | −24% |
| 15% | | | | | 6 | −71% | | | 10 | −41% |
| 20% | 17 | −15% | 7 | −61% | 3.5 | −83% | 11 | −27% | 8 | −53% |
| 25% | | | | | 3.5 | −83% | | | 2.5 | −85% |
| 30% | 12 | −40% | 3 | −83% | 0 | −100% | 7 | −53% | | |
| 35% | | | | | | | | | | |
| 40% | 12 | −40% | | | | | 3.5 | −77% | | |
| 45% | | | | | | | 3 | −80% | | |
| 50% | 7 | −65% | | | | | 1.5 | −90% | | |
| 55% | | | | | | | | | | |
| 60% | 4 | −80% | | | | | 0 | −100% | | |
| 65% | | | | | | | | | | |
| 70% | 2.5 | −88% | | | | | | | | |
| 75% | | | | | | | | | | |
| 80% | 2 | −90% | | | | | | | | |

Table 4 lists the width of the entire nettings (i) to (v), where no values for netting (iii), i.e., Net 5 have been measured in detail because Net 5 did not show lateral shrinkage at the target elongation of about 25%.

TABLE 4

| Width of the entire netting (mm) | | | | | | | | | | |
|---|---|---|---|---|---|---|---|---|---|---|
| | Net 1 | | Net 2 | | Net 3 | | Net 4 | | Net 5 | |
| elongation | Distance | Shrinkage | Distance | Shrinkage | Distance | Shrinkage | Distance | Shrinkage | Distance | Shrinkage |
| 0% | 460 | | 385 | | 395 | | 460 | | | |
| 5% | | | | | 385 | −3% | | | | |
| 10% | 460 | 0% | 370 | −4% | 375 | −5% | | | | |
| 15% | | | | | 360 | −9% | | | | |
| 20% | 460 | 0% | 345 | −10% | 350 | −11% | | | | |
| 25% | | | | | 340 | −14% | | | | |
| 30% | 460 | 0% | 320 | −17% | 320 | −19% | 455 | −1% | | |
| 35% | | | | | | | | | | |
| 40% | 458 | 0% | | | | | | | | |
| 45% | | | | | | | | | | |
| 50% | 450 | −2% | | | | | 450 | −2% | | |
| 55% | | | | | | | | | | |
| 60% | 449 | −2% | | | | | | | | |
| 65% | | | | | | | | | | |

TABLE 4-continued

| | Width of the entire netting (mm) | | | | | | | | | |
|---|---|---|---|---|---|---|---|---|---|---|
| | Net 1 | | Net 2 | | Net 3 | | Net 4 | | Net 5 | |
| elongation | Distance | Shrinkage | Distance | Shrinkage | Distance | Shrinkage | Distance | Shrinkage | Distance | Shrinkage |
| 70% | 435 | −5% | | | | | 390 | −15% | | |
| 75% | | | | | | | | | | |
| 80% | 425 | −8% | | | | | | | | |

From Tables 1 and 2 follows that, for the nettings (i)-(v), the lateral shrinkage at 20% elongation and the lateral shrinkage at 50% of the respective target elongations is below 10%. The lateral shrinkage at 20% elongation and the lateral shrinkage at 50% of the respective target elongations is above 10% for the distance between the indicator franzes as can be seen from Table 3. At the target elongation, the distance between the indicator franzes has decreased by at least 85% for all tested nettings, and even up to 100% for some nettings. As can be seen from Table 4, using interpolation where necessary, the lateral shrinkage of the entire nettings at 20% elongation and the lateral shrinkage of the entire nettings at 50% of the respective target elongations is below 10% for Net 1, Net 4, and Net 5, which use schusses with length reserve as first schusses. The conventional nettings Net 2 and Net 3 show a shrinkage of the entire netting of 10% and 11% at 20% elongation. The distance between the indicator franzes decreases much faster than the distance between non-indicator franzes such as the first and second pair of franzes, namely at least 5 times faster in the measured cases.

It is to be understood that features described with respect to one embodiment may also be used in combination with other embodiments, yielding yet further embodiments of the invention. The foregoing is directed to embodiments presented for illustration. Yet, other and further embodiments may be devised without departing from the basic scope determined by the claims that follow.

The invention claimed is:

1. A method of determining the longitudinal elongation of a knitted netting with respect to a target elongation, comprising:

providing the knitted netting including first longitudinal franzes, first lateral schusses, at least two second longitudinal franzes, and at least one second lateral schuss, the schusses knitted with the franzes to form the knitted netting, wherein first longitudinal franzes and first lateral schusses are configured such that the spacing of the first longitudinal franzes decreases by less than 10% when elongating the knitted netting by 50% of the target elongation, the target elongation being from 15% to 400% of the length of the knitted netting, and wherein the second lateral schuss is an indicator schuss, the second longitudinal franzes are indicator franzes, and the indicator schuss is knitted with the indicator franzes to form an elongation indicator for indicating the amount of longitudinal stretching of the knitted netting, the elongation indicator being configured such that the spacing of the indicator franzes decreases by more than 10% when elongating the knitted netting by 50% of the target elongation;

stretching the netting in longitudinal direction; and determining the longitudinal elongation of the knitted netting from the elongation indicator.

2. The method of claim 1, wherein determining the longitudinal elongation comprises determining when the indicator franzes reach a predetermined spacing from each other, thereby indicating reaching of the target longitudinal elongation of the netting.

3. The method of claim 1, wherein determining the longitudinal elongation of the knitted netting comprises determining when the spacing between the indicator franzes decreases to at most 10% of the spacing between the indicator franzes before stretching of the netting, or to at most 5% or to substantially zero or to zero, thereby indicating reaching of the target longitudinal elongation of the netting.

4. The method of claim 1, wherein the length of the indicator schuss controls the spacing between the indicator franzes when the knitted netting is stretched in longitudinal direction.

5. The method of claim 4, wherein the length of the indicator schuss is substantially equal to the length of the netting plus the target elongation, and stretching the netting in longitudinal direction comprises stretching the netting until the indicator schuss is substantially straightened along the longitudinal direction.

6. The method of claim 1, wherein the indicator franzes and indicator schuss forming the elongation indicator are arranged in a center region or in the center of the netting.

7. The method of claim 1, further comprising:

wrapping an object with the knitted netting when the target longitudinal elongation has been reached.

8. A knitted netting for wrapping an object, comprising:

first longitudinal franzes, first lateral schusses, at least two second longitudinal franzes, and at least one second lateral schuss, the schusses knitted with the franzes to form the knitted netting, wherein first longitudinal franzes and first lateral schusses are configured such that the spacing of the first longitudinal franzes decreases by less than 10% when elongating the knitted netting by 20% or when elongating the knitted netting by 50% of a target elongation, the target elongation being from 15% to 400% of the length of the knitted netting, and wherein the second lateral schuss is an indicator schuss, the second longitudinal franzes are indicator franzes, and the indicator schuss is knitted with the indicator franzes to form an elongation indicator for indicating the amount of longitudinal stretching of the knitted netting, the elongation indicator being configured such that the spacing of the indicator franzes decreases by more than 10% when elongating the knitted netting by 20% or when elongating the knitted netting by 50% of the target elongation.

9. A knitted netting for wrapping an object, comprising:

first longitudinal franzes, first lateral schusses, at least two second longitudinal franzes, and at least one second lateral schuss, the schusses knitted with the franzes to form the knitted netting, wherein first longitudinal franzes and first lateral schusses are configured such that the spacing of the first longitudinal franzes decreases by a first percentage when elongating the knitted netting by 20% or when elongating the knitted netting by 50% of a target elongation, the target elongation being from 15% to 400% of the length of the knitted netting, and wherein the second lateral schuss is an indicator schuss, the second longitudinal franzes are indicator franzes, and the indicator schuss is knitted with the indicator franzes to form an elongation indicator for indicating the amount of longitudinal stretching of the knitted netting, the elongation indicator being configured such that the spacing of the indicator franzes decreases by a second percentage when elongating the knitted netting by 20% or when elongating the knitted netting by 50% of the target elongation, wherein the ratio of the second percentage to the first percentage is larger than 1.5.

10. The netting of claim 9, wherein the elongation indicator is configured to indicate the target elongation of the knitted netting by a decrease of the spacing of the indicator franzes by at least 85%, or by at least 90%, or by at least 95%, or by substantially 100% or even by 100%.

11. The netting of claim 9, wherein the length of the indicator schuss is configured to control the spacing between the indicator franzes.

12. The netting according to claim 11, wherein the length of the indicator schuss is configured to be substantially equal to the length of the netting plus the target elongation.

13. The netting of claim 9, wherein the indicator franzes and indicator schuss forming the elongation indicator are arranged in a center region or in the center of the netting.

14. The netting of claim 9, wherein the at least two indicator franzes and/or the at least one indicator schuss have a different color than the first longitudinal franzes and lateral schusses.

15. A netting for wrapping an object, comprising:

first longitudinal ribbons and first lateral ribbons, and at least one indicator ribbon with at least one characteristic responsive to longitudinal stretching of the netting, the at least one specific characteristic being different from the corresponding characteristics of the first ribbons, wherein the at least one characteristic of the at least one indicator ribbon is configured to effect an indication of a longitudinal elongation of the netting when the netting is stretched in longitudinal direction, wherein the netting is a knitted netting for wrapping an object with the knitted netting having an indicated target elongation, the netting comprising:

first longitudinal franzes, first lateral schusses, at least two second longitudinal franzes, and at least one second lateral schuss, the schusses knitted with the franzes to form the knitted netting, wherein first longitudinal franzes and first lateral schusses are configured such that the spacing of the first longitudinal franzes decreases by less than 10% when elongating the knitted netting by 50% of the target elongation, the target elongation being from 15% to 300% of the length of the knitted netting, and wherein the second lateral schuss is an indicator schuss, the second longitudinal franzes are indicator franzes, and the indicator schuss is knitted with the indicator franzes to form an elongation indicator for indicating the amount of longitudinal stretching of the knitted netting, the elongation indicator being configured such that the spacing of the indicator franzes decreases by more than 10% when elongating the knitted netting by 50% of the target elongation.

16. The netting of claim 15, wherein the first longitudinal ribbons are spatially separated and are connected by the first lateral ribbons, the netting further comprising at least two longitudinal indicator ribbons with a spacing between them, wherein the at least one indicator ribbon is a lateral indicator ribbon connecting the at least two longitudinal indicator ribbons such that the spacing between the at least two longitudinal indicator ribbons is the at least one characteristic, is controlled by a specifically designed value of the length of the at least one lateral indicator ribbon, and decreases to a greater extent than the spacing between the first longitudinal ribbons when the netting is stretched in longitudinal direction, and wherein the at least two longitudinal indicator ribbons and the at least one lateral indicator ribbon form an elongation indicator of the netting adapted to indicate the target longitudinal elongation of the netting when the longitudinal indicator ribbons reach a predetermined lateral distance from each other when the netting is stretched in longitudinal direction.

17. The netting of claim 15, wherein the elongation indicator is configured to indicate the target elongation of the knitted netting by a decrease of the spacing of the indicator franzes by at least 85%, or by at least 90%, or by at least 95%, or by substantially 100% or even by 100%.

18. The netting of claim 8 wherein the netting is used to measure the longitudinal elongation of the netting by the elongation indicator.

19. The netting of claim 8, wherein the elongation indicator is configured to indicate the target elongation of the knitted netting by a decrease of the spacing of the indicator franzes by at least 85%, or by at least 90%, or by at least 95%, or by substantially 100% or even by 100%.

20. The netting of claim 8, wherein the length of the indicator schuss is configured to control the spacing between the indicator franzes.

21. The netting according to claim 20, wherein the length of the indicator schuss is configured to be substantially equal to the length of the netting plus the target elongation.

22. The netting of claim 8, wherein the indicator franzes and indicator schuss forming the elongation indicator are arranged in a center region or in the center of the netting.

23. The netting of claim 8, wherein the at least two indicator franzes and/or the at least one indicator schuss have a different color than the first longitudinal franzes and lateral schusses.

* * * * *